US005380607A

United States Patent [19]

Van Haute et al.

[11] Patent Number: 5,380,607

[45] Date of Patent: Jan. 10, 1995

[54] THERMAL IMAGING METHOD

[75] Inventors: Robert C. Van Haute, Temse; Luc H. Leenders, Herentals; Roland F. Beels, Aartselaar; Carlo A. Uyttendaele, Berchem; Herman J. Uytterhoeven, Bonheiden, all of Belgium; Wolfgang Podszun, Köln, Germany

[73] Assignee: Agfa-Gevaert, N.V., Mortsel, Belgium

[21] Appl. No.: 149,233

[22] Filed: Nov. 9, 1993

[30] Foreign Application Priority Data

Nov. 17, 1992 [EP] European Pat. Off. ..... 92203511.8

[51] Int. Cl.[6] ..... G03C 5/54

[52] U.S. Cl. ..... 430/3; 430/22; 430/200; 430/201; 430/964; 503/227

[58] Field of Search ..... 430/3, 22, 200, 201, 430/964; 503/227

[56] References Cited

U.S. PATENT DOCUMENTS

| | | | |
|---|---|---|---|
| 4,388,362 | 6/1983 | Iwata et al. | 430/200 |
| 4,651,177 | 3/1987 | Morishita et al. | 503/227 |
| 4,688,057 | 8/1987 | Ueyama et al. | 503/204 |
| 4,879,564 | 11/1989 | Long | 430/3 |
| 4,904,572 | 2/1990 | Dombrowski et al. | 430/964 |
| 4,915,519 | 4/1990 | Ardakani et al. | 430/200 |
| 5,061,677 | 10/1991 | Yoshida et al. | 503/226 |
| 5,183,798 | 2/1993 | Sarraf et al. | 430/200 |
| 5,219,703 | 6/1993 | Bugner et al. | 430/200 |
| 5,256,623 | 10/1993 | Fukuda | 503/227 |
| 5,284,816 | 2/1994 | Stephenson | 503/227 |

*Primary Examiner*—Richard L. Schilling
*Attorney, Agent, or Firm*—Breiner & Breiner

[57] ABSTRACT

A thermal imaging process comprising the step of imagewise heating a donor element so as to transfer therefrom colored matter onto a contacting receptor element, characterized in that before said imagewise heating said receptor element contains in a layer at least one substance that by heat applied in the transfer of said colored matter undergoes a change giving rise to an increase in optical density.

10 Claims, No Drawings

THERMAL IMAGING METHOD

DESCRIPTION

1. Field of the Invention

The present invention relates to a thermal imaging method and to materials suited for use according to said method.

2. Background of the Invention

Thermal imaging or thermography is a recording process wherein images are generated by the use of imagewise modulated thermal energy.

In thermography two approaches are known:

1. Direct thermal formation of a visible image pattern by imagewise heating of a recording material containing matter that by chemical or physical process changes colour or optical density.
2. Formation of a visible image pattern by transfer of a coloured species from an imagewise heated donor element onto a receptor element.

A survey of "direct thermal" imaging methods is given in the book "Imaging Systems" by Kurt I. Jacobson-Ralph E. Jacobson, The Focal Press—London and New York (1976), Chapter VII under the heading "7.1 Thermography". Thermography is concerned with materials which are not photosensitive, but are heat sensitive. Imagewise applied heat is sufficient to bring about a visible change in a thermosensitive imaging material.

According to a direct thermal embodiment operating by physical change a recording material is used which contains a coloured support or support coated with a coloured layer which itself is overcoated with an opaque white light reflecting layer that can fuse to a clear, transparent state whereby the coloured support is no longer masked. Physical thermographic systems operating with such kind of recording material are described on pages 136 and 137 of the above mentioned book of Kurt I. Jacobson et al.

Yet most of the "direct" thermographic recording materials are of the chemical type. On heating to a certain conversion temperature, an irreversible chemical reaction takes place and a coloured image is produced.

One large group of chemical thermographic systems operates with thermosensitive recording materials wherein two colour forming reactants are present, one of which fuses in the range of 60°-120° C. and reaches thereby the other reactant. According to another embodiment one of the colour-forming reactants is present in a meltable microcapsule shell or kept separate from the other reactant by a meltable barrier layer that on fusing no longer prevents the direct contact of the colour forming reaction partners.

A wide variety of chemical systems has been suggested some examples of which have been given on pages 138 and 139 of the above mentioned book of Kurt I. Jacobson et al. and by A. S. Diamond, "Specialty papers for thermal imaging", Proceedings of White Papers & Office Automation Conference, MA, 1989.

Thermal dye transfer printing is a recording method wherein a dye-donor element is used that is provided with a dye layer wherefrom dyed portions or incorporated dye is transferred onto a contacting receiver element by the application of heat in a pattern normally controlled by electronic information signals.

According to one embodiment dye images are produced by thermal-ink transfer printing by selectively energizing the electrical resistors of a thermal head array in contact with a thin thermally stable resin base, which contains on its opposite side a so-called ink-layer from which a dye can be thermally transferred onto a receptor material.

According to another embodiment known as resistive ribbon non-impact printing [ref. e.g. Progress in Basic Principles of Imaging Systems—Proceedings of the International Congress of Photographic Science Köln (Cologne), 1986, editors: Friedrich Granzer and Erik Moisar, Friedr. Vieweg & Sohn—Braunschweig/Wiesbaden, Journal of Imaging Technology, Vol. 12, No. 2, April 1986, p. 100-110 and Journal of Imaging Science—Volume 33, No. 1, January/February 1989, p. 7] from an electrode-array electrical current is sent pixelwise into a resistive ribbon coated at the other side with a thermally transferable dye.

According to still another embodiment known as laser-induced thermal dye transfer (ref. e.g. U.S. Pat. No. 4,876,235) a dye donor element is used which contains a thermally transferable dye and a finely divided substance that is heated by absorbing laser light. Using an infrared emitting laser and a dye-donor element containing an infrared absorbing material convection-heat is generated in said element by the absorbed infra-red light (ref. e.g. U.S. Pat. No. 4,912,083).

The image signals for modulating the laser beam or electrode current are obtained directly e.g. from optoelectronic scanning devices or from an intermediary storage means, e.g. magnetic disc or tape or optical disc storage medium, optionally linked to a digital image work station wherein the image information can be processed to satisfy particular needs.

According to a more recently disclosed technique, see e.g. U.S. Pat. No. 4,908,631, an ultrasonic pixel printer is used for applying the necessary thermal energy to a dye donor layer to cause the dye to melt and/or sublime and transfer to a receiver element.

Thermal dye transfer processes are intended mainly for multicolour dye image reproduction but are also suited for the production of monochrome images including black images, which means that black-and-white and/or colour prints can be made by printing with an adapted dye-donor element.

Direct thermal imaging and thermal dye transfer can be used for both the production of reflection type prints (having an opaque white light reflecting background) and transparencies. In the medical diagnostic field black-and-white or monochrome transparencies find wide application in inspection techniques operating with a light box.

For the production of black-and-white prints use is made of dye-donor elements having a black dye area. Instead of a black dye a mixture of dyes can also be employed, which mixture is then chosen such that a neutral black transfer image is obtained. It is of course also possible to produce a black image by printing from several dye areas one dye over the other and in register. However, this procedure is less suitable because it is more time-consuming and needs a higher length of donor element.

The optical density of transparencies produced by thermal transfer procedure is rather low and in most of the commercial systems—in spite of the use of donor elements specially designed for printing transparencies—only reaches 1 to 1.2 (as measured by a Macbeth Quantalog Densitometer Type TD 102). However, for many application fields a considerably higher transmission density is asked for. For instance in the medical diagnostical field a maximal transmission density of at least 2.5 is desired.

One way to enhance the density of a transferred image is to merely increase the amount of dye in the dye-donor element and also to increase the amount of power used to transfer the dye. However, this is costly in terms of material and power requirements. Moreover, it is difficult to coat higher amounts of dye in the dye-binder layer without impairing the stability of the dye-donor element. Indeed, when the dye coverage in the dye-binder layer is enhanced, the dye tends to crystallize during storage of the dye-donor element, and an enhanced content of dye may stick the heat-sensitive donor layer in a wind-up recording donor material to the rearside of its support so that the thermal head may be soiled during the printing operation.

Increasing the power to the thermal head generally may cause deformation of the receiving sheet hindering the passage of the dye-donor element in contact with the thermal head and results in more rapid wear of the resistor elements of the thermal head.

Another way to enhance the density of a transferred image is to lower the amount of binder in the dye-donor element, thereby lowering the path length of the diffusing dye and increasing the dye transfer efficiency, but such may affect the longterm stability of the dye-donor element. Other ways to enhance the density of the transferred image are by introducing new dyes that have higher thermal dye efficiency and/or by introducing substances, e.g. thermosolvents that increase the transfer efficiency of the dyes, but such may be likewise in disfavour of the longterm stability of the dye-donor elements.

In U.S. Pat. No. 4,833,124 a process has been described for increasing the density by printing twice or several times in register on one side of a receiving sheet. Unfortunately, this procedure suffers from several important disadvantages. It needs a considerable length of donor element and produces more waste. It is very time-consuming since it involves repeated passages of the receiving sheet along the thermal printing head. Moreover, only limited increases in density can be accomplished because the dye-image-receiving layer of the receiving sheet is saturated for the greater part by the dye transferred during the first passage and as a result of said dye saturation accepts far less dye during the next passage(s). Furthermore, during passage of the dye-image-receiving layer for the second time or subsequent times along the thermal printing head the already transferred dye partially migrates back to the dye layer. Thus, the density of the transferred dye image only increases in a limited way during the second and especially during further passages.

It would be desirable to provide a thermographic system according to which optical density is added to images obtained by a thermal dye transfer process without suffering from the above-mentioned disadvantages.

3. Objects and Summary of the Invention

It is an object of the present invention to provide a thermal imaging process operating with a donor and receptor element wherein a receptor element is used in which an enhancement of optical image density can be obtained in conformity with image matter transferred by heat applied during the thermal transfer of said imaging matter.

It is another object of the present invention to provide receptor elements suited for use in said process.

Other objects and advantages of the present invention will appear from the further description and examples.

In accordance with the present invention a thermal imaging process is provided comprising the step of imagewise heating a donor element so as to transfer therefrom coloured matter onto a contacting receptor element, characterized in that before said imagewise heating said receptor element contains in a layer at least one substance that by heat applied in the transfer of said coloured matter undergoes a change giving rise to an increase in optical density.

A receptor element suited for use in said thermal imaging process according to the present invention comprises a support having on at least one side thereof in a binder layer at least one substance that by chemical reaction activated by heat can give rise to an increase in optical density in conformity with a pattern of a coloured matter deposited onto said receptor element by thermal transfer, and wherein said binder layer serves as outermost receptor layer or is,coated optionally through the intermediary of a subbing layer with an outermost receptor layer which outermost receptor layer is suited for receiving coloured matter transferred by heat, e.g. transferred by sublimation or from a melt.

Another receptor element suited for use in said thermal imaging process according to the present invention comprises a support having on at least one side thereof an opaque layer that can be transparentized by heat applied in conformity with a pattern of a coloured matter deposited onto said receptor element by thermal transfer, and wherein said opaque layer at its side remote from the support is arranged in close proximity or contact with an outermost receptor layer suited for receiving coloured matter transferred by heat and at the other side directed to the support is arranged in close proximity or contact with a coloured layer the colour of which can be seen when said opaque layer is transparentized by heat.

4. Detailed Description of the Invention

In a first embodiment of the method according to the present invention the imagewise transfer of coloured matter onto the receptor element (sheet, ribbon or web) proceeds by Joule effect heating in that selectively energized electrical resistors of a thermal head array are used in contact with a thin thermally stable resin base of a donor element (sheet, ribbon or web optionally coated at its rear side with a heat-resistant layer) whereon said colouring matter (e.g. meltable or sublimable dye or mixture of dyes) is present in a wax or polymeric binder layer. The receptor element being held in contact with said wax or polymeric binder layer receives imagewise some of said colouring matter optionally together with said wax or polymeric binder. Thermal energy of the energized electrical resistors after heating the donor element reaches the receptor element and heats therein a binder layer containing a chemical composition of substances producing a change in colour due to reaction activated by heat. The chemically formed image is in register with the thermally transferred image and adds optical density to the optical density of said transferred image. The chemically formed image compensates for lack of density of the image of transferred colouring matter and/or changes its hue.

Thermal printing heads that can be used to transfer dye from dye-donor elements to a receiving sheet according to the present invention are commercially available. Suitable thermal printing heads are e.g. a Fujitsu Thermal Head (FTP-040 MCS001), a TDK Thermal Head F415 HH7-1089, and a Rohm Thermal Head KE 2008-F3 and Kyocera Thermal Head KST-219-12-12MPG 27.

In the production of monochrome images the colour obtained by chemical reaction has not necessarily the hue of the image transferred by heat. For forming black images the colour of the thermally transferred image and the colour of the image chemically formed by heat may be complementary, e.g. is blue and yellow respectively.

The background of the thermally obtained images has to be sufficiently contrasting in colour and optical density so as to make it possible to detect the image visually and/or by machine reading.

In a special embodiment of imagewise electrically heating the dye donor element by Joule effect, the support of the dye-donor element or an outermost layer system applied thereto is forming an electrically resistive ribbon type element consisting of e.g. a multilayered structure of a carbon-loaded polycarbonate coated with a thin aluminium film. Current is injected into the resistive ribbon by electrically addressing a print head electrode, thus resulting in highly localized heating of the ribbon beneath the relevant electrode. The fact that in this case the heat is generated directly in the resistive ribbon and only the travelling ribbon gets hot (not the print heads) an inherent advantage in printing speed is obtained. In applying the thermal printing head technology the various elements of the thermal printing head get hot and must cool down before the head can print without cross-talk in a next position.

In a second embodiment of the method according to the present invention the dye donor element and the receptor element in intimate contact therewith is heated by means of an imagewise modulated laser beam. For example, imagewise modulated laser light is used in conjunction with a dye donor element which contains a thermally transferable dye and optionally a finely divided substance that is heated by absorbing laser light.

Optionally the receptor element contains light-into-heat converting substances, e.g. infrared absorbing substances.

In a special embodiment operating with infrared laser light a dye donor element incorporating a heat-transferable coloured substance in conjunction with at least one heat-transferable infrared light absorbing substance is used to form a coloured infrared light absorbing pattern on the receptor element. In said embodiment the receptor element after the dye transfer thereto together with the infrared light absorbing substance is exposed uniformly to infrared light, e.g. of an infrared light emitting laser, and the receptor element containing already a transferred dye image is additionally heated thereby in conformity with the transferred infrared light absorbing matter. The infrared light absorbing substances can likewise be provided in the receiving element. The heat is then generated in the receiving element and transferred to the contacting dye donor element thereby causing transfer of coloured substances.

The use of an infrared light emitting laser and a dye-donor element containing an infrared light absorbing material is described e.g. in U.S. Pat. No. 4,912,083. Suitable infra-red light absorbing dyes for laser-induced thermal dye transfer are described e.g. in U.S. Pat. No. 4,948,777.

The imagewise applied laser light has not necessarily to be infrared laser light since the power of a laser in the visible light range and even in the ultraviolet region can be thus high that sufficient heat is generated on absorption of the laser light in the dye donor element.

In a third embodiment the imagewise heating of the donor element proceeds by means of pixelwise modulated ultra-sound, using e.g. an ultrasonic pixel printer as described e.g. in U.S. Pat. No. 4,908,631.

Examples of heat-activatable chemical colour reactions for use in a thermal imaging method according to the present invention are the following.

In a first example a heat-activatable diazo system is used in a dye receptor element wherein the coupler and/or base needed to form a dye by reaction with a diazonium salt are available in chemically blocked state wherefrom they can be set free by heat and allowed to react with the diazonium salt in the same receptor element. After the imagewise heating of the receptor element in congruency with the image of heat-transferred colouring matter (dye), the receptor material is exposed uniformly to ultraviolet radiation to destroy residual non-reacted diazonium salt whereby the imaged receptor material is no longer capable of developing a dye in the background areas of the transferred image.

According to a special mode the receptor element incorporates a diazo system wherein the diazonium salt is encapsulated. Thermally induced permeation of the capsule permits reaction of the diazonium salt with a coupler and base outside the capsules, resulting in colour formation. After the imagewise heating of the receptor element in congruency with the image of heat-transferred colouring matter, the receptor element is exposed uniformly to ultraviolet radiation to destroy residual non-reacted diazonium salt in the capsules whereby the imaged receptor material looses its dye forming property and the background areas of the transferred image can no longer be stained.

In a second example a dye receptor element contains a leuco dye in one binder layer and a thermosensitive acid precursor or solid meltable acid in another binder layer in such a way that under the influence of heat acid can meet the leuco dye and produce a dye therewith. A material containing such binder layer is described in published German patent application (DE-OS) 24 43 349, and suitable acids and leuco bases are described e.g. in U.S. Pat. No. 3,957,288.

According to a special mode the acid sensitive leuco dye, also called leuco base, is encapsulated in microcapsules shielding in unheated state the leuco base(s) from a uniformly present acidic matrix. Thermally induced permeation of the capsule walls permits reaction of the leuco base(s) with the acid of the surrounding matrix, resulting in colour formation.

According to another special mode prior to the imagewise heating the leuco base and acid or a thermosensitive acid precursor are kept separate, e.g. by a polymeric barrier layer wherethrough the acid can diffuse by heating.

Examples of dye precursors being carbinol type leuco bases to be used in combination with an acidic compound functioning as colour developing agent are described in U.S. Pat. No. 3,957,288.

Other examples of useful dye precursors are triarylmethanelactone compounds such as 3,3-bis(p-dimethylaminophenyl)-6-dimethylaminophthalide, 3,3-bis(p-dimethylaminophenyl)phthalide, 3-(p-dimethylaminophenyl)3-(1,2-dimethylindole-3-yl)phthalide, 3-(p-dimethylaminophenyl)-3-(2-methylindole-3-yl)phthalide, 3,3-bis(1,2-dimethylindole-3-yl)-5-dimethylaminophthalide, 3,3-bis(1,2-dimethylindole-3-yl)-6-dimethylaminophthalide, 3,3-bis(9-ethylcarbazole-3-yl)-6-dimethylaminophthalide, 3,3-bis(2-phenylindole-3-yl)-6-dimethylaminophthalide, 3-p-dimethylaminophenyl -3-(1-methylaminophthalide and the like; diphenylmethane compounds such as 4,4-bis-dimethylaminobenzhydryl benzyl ether, N-halophenyl-leucoauramine, N-2,4,5-trichlorophenyl-leucoauramine and the like; thiazine compounds such as benzoyl-leucomethylene bleu, p-nitrobenzoyl-leucomethylene blue and the like; spiro compounds such as 3-methyl-spiro-dinaphthopyran, 3-ethyl-spiro-dinaphthopyran, 3-benzyl-spiro-dinaphthopyran, 3-methyl-naphtho-(6-methoxybenzo)spiropyran, 3-propyl-spiro-dibenzopyran and the like; lactam compounds such as Rhodamine-B anilinelactam, Rhodamine(p-nitroanilino)lactam, Rhodamine(o-chloroanilino)lactam and the like; and fluoran compounds such as 3-dimethylamino-7-methoxyfluoran, 3-diethylamino-6-methoxyfluoran, 3-diethylamino-7-methoxyfluoran, 3-diethylamino-6-methyl-7-chlorofluoran, 3-diethylamino-6,7-dimethylfluoran, 3-(N-ethyl-p-toluidino)-7-methylfluoran, 3-diethylamino-7-N-acetyl-N-methylaminofluoran, 3-diethylamino-7-N-methylaminofluoran, 3-diethylamino-7 -dibenzylamino-7-N-methyl-N-benzylaminofluoran, 3-diethylamino-7-N-chloroethyl-N-methylaminofluoran, 3-diethylamino-7-N-diethylaminofluoran, 3-(N-ethyl-p-toluidino)-6-methyl-7-phenylaminofluoran, 3-(N-ethyl-p-toluidino)-6-methyl-7-(p-toluidino)fluoran, 3-diethylamino-6-methyl-7-phenylaminofluoran, 3-di-n-butylaminofluoran, 3-diethylamino-7-(2-carbomethoxyphenylamino)-fluoran, 3-(N-cyclohexyl-N-methylamino)-6-methyl-7-phenylaminofluoran, 3-(N-cyclopentyl-N-methylamino)-6-methyl-7-phenylaminofluoran, 3-(N-cyclopentyl-N-ethylamino)-6-methyl-7-phenylaminofluoran, 3-(N-cyclohexyl-N-ethylamino)-6-methyl-7-phenylaminofluoran, 3-(N-3',3',5'-trimethylcyclohexyl-N-methylamino)-6-methyl-7-phenylaminofluoran, 3-pyrrolidino-6-methyl-7-phenylaminofluoran, 3-piperidino-6-methyl-7-phenylaminofluoran, 3-diethylamino-6-methyl-7-xylidinofluoran, 3-diethylamino-7-(o-chlorophenylamino)-fluoran, 3-dibutylamino-7-(o-chlorophenylamino)fluoran, 3-pyrrolidino-6-methyl-7-p-butylphenyl aminofluoran, 3-diethylamino-7-(o-fluorophenylamino)fluoran, 3-dibutylamino-7-(o-fluorophenylamino)fluoran, 3-(N-methyl-N-n-amyl-)amino-6-methyl- 7-phenylaminofluoran, 3-(N-ethyl-N-n-amyl)amino-6-methyl-7-phenylaminofluoran, 3-(N-methyl-N-n-hexyl)amino-6-methyl-7-phenylaminofluoran, 3-(N-ethyl-N-n-hexyl)amino-6-methyl-7-phenylaminofluoran, 3-(N-ethyl-N-6-ethylhexyl)-amino-6-methyl-7-phenylaminofluoran, 3-(N-ethyl-N-tetrahydrofurfurylamino)-6-methyl-7-phenylfluoran and the like. Still further dye precursors for use in connection with the present invention are disclosed in e.g. U.S. Pat No. 4,803,148, EP-A-302529, DE-A-3.807.744, DE-A-3.942.227, DE-A-3.810.207, U.S. Pat. No. 4,753,759 and the references cited therein. These dye precursors may be used either solely or in combination.

Useful colour developers for these dye precursors are for example, phenolic compounds such as 4-tert-butylphenol, α-naphthol, β-naphtol, 4-acetylphenol, 4-phenylphenol, hydroquinone, 4,4'-isopropylidenediphenol(=Bisphenol A), 2,2'-methylenebis(4-chlorophenol), 4,4'-cyclohexylidenediphenol, 4,4'-dihydroxydiphenylsulfide, hydroquinone monobenzylether, 4-hydroxybenzophenone, 2,4-dihydroxybenzophenone, 2,4,4'-trihydroxybenzophenone, 2,2',4,4'-tetrahydroxybenzophenone, dimethyl 4-hydroxyphthalate, methyl 4-hydroxybenzoate, ethyl 4-hydroxybenzoate, propyl 4-hydroxybenzoate, sec-butyl 4-hydroxybenzoate, pentyl 4-hydroxybenzoate, phenyl 4-hydroxybenzoate, benzyl 4-hydroxybenzoate, tolyl 4-hydroxybenzoate, chlorophenyl 4-hydroxybenzoate, phenylpropyl 4-hydroxybenzoate, phenetyl 4-hydroxybenzoate, p-chlorobenzyl 4-hydroxybenzoate, p-methoxybenzyl 4-hydroxybenzoate, novolak phenol resin, phenol polymers and the like; aromatic carboxylic acids such as benzoic acid, p-tert-butylbenzoic acid, trichlorobenzoic acid, terephthalic acid, 3-sec-butyl-4-hydroxybenzoic acid, 3-cyclohexyl-4-hydroxybenzoic acid, 3,5-dimethyl-4-hydroxybenzoic acid, salicylic acid, 3-isopropylsalicylic acid, 3-benzylsalicylic acid, 3-(α-methylbenzyl)salicylic acid, 3-chloro-5-(α-methylbenzyl)salicylic acid, 3,5-di-tert-butylsalicylic acid, 3-phenyl-5-(α,α-dimethylbenzyl)salicylic acid, 3,5-di(α-methylbenzyl)-salicylic acid and the like; and salts of the above phenolic compounds or aromatic carboxylic acids with polyvalent metals such as zinc, magnesium, aluminium, calcium, titanium, manganese, tin and nickel.

Other colour developers are 4-hydroxydiphenylsulfone derivatives such as 4,4'-dihydroxydiphenylsulfone, 3,3'-dipropenyl-4,4'-dihydroxydiphenylsulfone, 4-hydroxy-4'-chlorodiphenylsulfone, 4-hydroxy-4'-methyldiphenylsulfone, 4-hydroxy-3'4'-dimethyldiphenylsulfone, 4-hydroxy-4'-ethyldiphenylsulfone, 4-hydroxy-4'-tert-butyldiphenylsulfone, 4-hydroxy-4'-n-octyldiphenylsulfone, 4-hydroxy-4'-n-octyldiphenylsulfone, 4-hydroxy-4'-methoxydiphenylsulfone, 4-hydroxy-4'-ethoxydiphenylsulfone, 4-hydroxy-4'-isopropyloxydiphenylsulfone, 4-hydroxy-4'-n-butoxydiphenylsulfone, 4-hydroxy-4'-tert-butoxydiphenylsulfone, 4-hydroxy-4'-isoamyloxydiphenylsulfone, 4-hydroxy-4'-n-octyloxydiphenylsulfone, 4-hydroxy-4'-benzyloxydiphenylsulfone, 4-hydroxy-4'-phenoxydiphenylsulfone, 3',4'-trimethylene-4-hydroxydiphenylsulfone, 3',4'-trimethylene-2,6-dimethyl -4-hydroxydiphenylsulfone, 3',4'-tetramethylene-4-hydroxydiphenylsulfone, 3',4'-tetramethylene-2-methyl -4-hydroxydiphenylsulfone and the like.

4-hydroxybenzenesulfonylnaphthalenes that may be used as colour developers include e.g. 1-(4-hydroxybenzenesulfonyl)naphthalene, 1-(4-hydroxybenzenesulfonyl)-4-methylnaphthalene, 1-(4-hydroxybenzenesulfonyl)-4-chloronaphthalene, 1-(4-hydroxy-2-methylbenzenesulfonyl)naphthalene, 1-(4-hydroxy-2-chlorobenzenesulfonyl)naphthalene, 1-(4-hydroxybenzenesulfonyl)-2,-dimethylnaphthalene, 1-(4-hydroxybenzenesulfonyl)-4-hydroxynaphthalene, 1-(4-hydroxybenzenesulfonyl)-2-hydroxynaphthalene, 1-(4-hydroxy-2-isopropylbenzenesulfonyl)naphthalene, 1-(4-hydroxy-2-isoamylbenzenesulfonyl)naphthalene, 1-(4-hydroxy-2-isopropyloxybenzenesulfonyl)-naphthalene, 1-(4-hydroxybenzenesulfonyl)-4-tert-butoxynaphthalene, 1-(4-hydroxy-2-benzyloxybenzenesulfonyl)naphthalene, 1-(4-hydroxy-2-phenoxybenzenesulfonyl)naphthalene, 2-(4-hydroxybenzenesulfonyl)naphthalene and the like.

Still other useful colour developers are halophthalic acid monoesters. Examples are monomethyl ester, monoethyl ester, monocyclopentyl ester, monoallyl ester, monobenzyl ester, mono-p-methylbenzyl ester, mono-p-chlorobenzyl ester, monophenethyl ester, monophenyl ester, mono-p-methyl phenyl ester, mono- 2,4-dimethylphenyl ester, mono-p-chlorophenyl ester, mono-p-ethoxyphenyl ester, mono-1-naphthyl ester, mono-2-naphthyl ester, mono-2-hydroxyethylester, mono-2-hydroxybutyl ester, mono-3-hydroxybutyl-2-ester, mono-2-(2-hydroxyethoxy)ethyl ester, mono-2-hydroxypropyl ester, mono-4-hydroxybutenyl ester, mono-4-hydroxybutyl ester, mono-2-hydroxycyclohexyl ester, mono-4-hydroxycyclohexyl ester and mono-2,3-dihydroxypropyl ester of halophthalic acids, such as 4 (or 5)-fluorophthalic acid, 4 (or 5)-chlorophthalic acid, 4 (or 5)-bromophthalic acid, 3,6 (or 4,5)-dicholorophthalic acid, 3,6 (or 4,5)-dibromophthalic acid, 3,4,5,6-tetrafluorophthalic acid, 3,4,5,6,-tetra chloropthalic acid, 3,4,5,6 -tetrabromophthalic acid and the like. Among the polyvalent metal compounds which form polyvalent metal salts with the above esters, there are included magnesium, calcium, barium, zinc, aluminium, tin, iron, cobalt, nickel and the like. Preferred metal salts are magnesium, calcium, barium and zinc salts.

Further suitable colour developers are disclosed in e.g. U.S. Pat. No. 4,803,148, EP-A-302529, DE-A-3.807.744, DE-A-3 942 227, DE-A-3 810 207, U.S. Pat. No. 4,753,759 and the references cited therein.

Binders for the layers containing the leuco dyes (i.e. dye precursors) or dye developers are e.g. polyesters, polyamides, e.g. N-methoxymethyl polyhexamethylene adipamide, vinylidene chloride copolymers, e.g. vinylidene chloride/acrylonitrile, vinylidene chloride/-methyl acrylate and vinylidene chloride/vinylacetate copolymers etc., ethylene/vinyl acetate copolymers, cellulosic ethers, e.g. methyl cellulose, ethyl cellulose and benzyl cellulose, polyethylene, synthetic rubbers, e.g. butadiene/acrylonitrile copolymers, and chloro-2-butadiene-,1,3 polymers, cellulose esters, e.g. cellulose acetate, cellulose acetate succinate and cellulose acetate butyrate, cellulose nitrate, polyvinyl esters, e.g. polyvinyl acetate/acrylate, polyvinyl acetate/methacrylate and polyvinyl acetate, polyacrylate and alpha-alkyl polyacrylate esters, e.g. polymethyl methacrylate and polyvinyl acetate, high molecular weight polyethylene oxides of polyglycols having average molecular weights from about 4,000 to 1,000,000, polyvinyl chloride and copolymers, e.g. polyvinyl chloride/acetate, polyvinylchloride/acetate/alkohol, polyvinyl acetal, e.g. polyvinyl butyral, polyvinyl formal, polyformaldehydes, polyurethanes and copolymers, polycarbonate and copolymers, polystyrenes and copolymers e.g. polystyrene/acrylonitrile, polystyrene/acrylonitrile/-butadiene, polyvinyl alcohol, cellulose, anhydrous gelatin, phenolic resins and melamine-formaldehyde resins etc., or mixtures of one ore more of the above polymers.

The layer containing the dye precursor will be free of polymers containing acid groups and phenolic groups. It is further preferred that the softening temperature of both layers is well above ambient temperature, preferably above 40° C. and more preferably above 60° C. The layers containing the dye precursor or colour developer can also contain immiscible polymeric or non-polymeric organic or inorganic fillers or reinforcing agents which are essentially colorless e.g. the organophilic silicas, bentonites, silica, powdered glass, $TiO_2$, $ZnO_2$ etc.

In a third example of a colour forming reaction activatable by heat the receptor element contains an organic reducible silver salt and a reducing agent, optionally in the presence of small amounts of silver halide, capable of forming silver metal in a redox reaction.

The organic reducible silver salt is e.g. an organic silver soap such as silver behenate or silver stearate. Suitable reducing agents for use in said redox reaction are described e.g. in U.S. Pat. No. 3,080,254 and U.S Pat. No. Re. 30,107. The chemistry of heat-activated silver image formation is described by Eric Brinckman et al. in the book "Unconventional Imaging Processes'-'—The Focal Press—London and New York, (1978), p. 74–75 and in the above mentioned book of Kurt I. Jacobson et al. p. 122.

By thermal development of organic silver salts in the presence of (a) reducing agent(s) and fogged light-sensitive silver halide silver image densities up to 3.0 can be obtained. By the use of colour developers and colour couplers in combination with organic silver salt silver halide that may be spectrally sensitized for optionally applied heat generating laser light it is possible to achieve colour image formation (ref. e.g. U.S. Pat. Nos. 3,531,286 and 4,535,056).

A receptor element suitable for use in a thermal imaging process according to the present invention dye transfer process requires the presence of an outermost layer adapted to receive the thermally transferred dye in such a way that on cooling the dye becomes fixed therein or adheres thereon.

According to one embodiment a receptor element suitable for use in a thermal imaging process comprises (1) a transparent or opaque support having on at least one side thereof (2) an organic polymer binder layer containing reagents producing a coloured substance by a chemical reaction activated by heat, characterized in that on said binder layer through the intermediary of a subbing layer or in direct contact therewith is present (3) an outermost transparent resin layer suited for receiving coloured matter transferred by heat, which transparent resin layer optionally also contains reagents producing a coloured substance by a chemical reaction activated by heat.

According to a modified embodiment said receptor element contains a dye precursor in one layer and a colour developer in an other layer with the possibility that on heating the receptor element the dye precursor can meet the colour developer in order to produce the desired colour reaction.

According to another modified embodiment said receptor element contains one of the colour forming reagents in microcapsules having a capsule shell that on heating allows the diffusion therethrough of said colour forming reagent to come in contact for colour reaction with the other reagent being present in a surrounding continuous binder matrix.

According to another modified embodiment said receptor element contains at least one of the colour forming substances in the layer receiving a coloured substance from the donor-element.

According to a further embodiment a receptor element suitable for use in a thermal imaging process of the present invention comprises (1) a support having on at least one side thereof (2) an organic polymer binder layer containing reagents producing a coloured substance by a chemical reaction activated by heat and on said binder layer in direct contact therewith (3) a hydrophilic colloid barrier layer which may act as a subbing layer, e.g. a gelatin-containing layer, preventing said reagents from entering (4) an outermost transparent resin layer, i.e. receptor layer, suited for receiving coloured matter transferred by heat. The barrier layer has a thickness in the range of e.g. 0.1 to 5 μm. The barrier layer contains preferably a film forming polymer that does not dissolve or swell in the solvent(s) for coating thereon the adjacent receptor layer.

According to a special mode said barrier layer is an impermeable resin layer that has been cured by radiation, e.g. is an EB (electron beam) or UV (ultraviolet) radiation cured resin layer. Suitable compositions for preparing radiation curable layers are described e.g. in Research Disclosure December 1977, item 16435 and in U.S. Pat. No. 4,110,187.

According to another special mode said barrier layer is an impermeable resin layer obtained by moisture-curing. Compositions suitable for preparing moisture-cured layers are described e.g. in U.S. Pat. No. 4,975,493.

The receptor element used in the thermal transfer process according to the present invention may contain a transparent or opaque sheet or web support.

Suitable transparent supports are resin supports made of e.g. polyethylene terephthalate, a polyether sulfone, a polyimide, a cellulose ester or a polyvinyl alcohol-co-acetal. Suitable opaque supports are opacified resin supports, e.g. coated with a white pigment layer or paper supports optionally coated with a resin layer, e.g. polypropylene layer.

The adhesion of the support of the receptor element to the heat-sensitive layer wherein by chemical reaction a colour change can be produced can be improved by providing a subbing layer in between.

Preferred dye-image-receiving layers are made of resins wherein a dye in molten or sublimated state can diffuse readily or whereto the coloured substance can adhere easily.

Examples of resins suitable for producing therewith a dye-image-receiving layer for thermal printing are polycarbonate resins, polyurethane resins, polyester resins, polyamide resins, polyvinyl chloride, copoly(vinyl chloride-vinyl acetate), copoly(vinyl chloride-vinyl acetate-vinyl alcohol), copoly(vinyl chloride-vinyl acohol), copolymers of vinyl chloride with monomers having reactive hydrogen atoms that have served to make crosslinks with polyisocyanates, to polystyrene-co-acrylonitrile, polycaprolactone or mixtures thereof, and further radiation cured acrylic or methacrylic resins (ref. e.g. published European patent application 394460). Suitable dye-image-receiving resin layers have been described in e.g. EP-A 0,133,011, EP-A 0,133,012, EP-A 0,144,247, EP-A 0,227,094, EP-A 0,228,066, U.S. Pat. No. 4,985,397 and published (PCT) WO 92/08839. Said dye-image-receiving resin layers are coated from organic solvent(s), but dye-image-receiving layers coated from a latex which is an aqueous dispersion of polymer(s) may be used likewise.

Suitable latex polymers for producing a dye-image-receiving layer for thermal printing are described e.g. in U.S. Pat. No. 4,478,907 relating to aqueous copolyester dispersions suited for the subbing of polyester film.

The dye-image-receiving layers are applied at a coverage effective for obtaining the desired optical density in thermal transfer imaging. In general, favourable results are obtained at coverages of from about 1 to about 10 g/m2.

UV-absorbers and/or antioxidants may be incorporated into the dye-image-receiving layers for improving the fastness to light of the transferred and/or chemically formed dyes.

A releasing agent that aids in separating the receptor element from the dye-donor element after transfer can be present in the dye-image-receiving layer. Solid waxes, fluorine- or phosphate-containing surfactants, and silicone oils and silicone resins can be used as releasing agent that optionally may be fixed in a cured structure or make part of such structure. Suitable releasing agents have been described in e.g. EP-A 0,133,012, JP 85/19138, and EP-A 0,227,092.

The dye-donor elements for use according to the thermal dye transfer method of the present invention may comprise printing dyes that can be released by fusion, vapourization, or sublimation. Suitable dyes for that purpose have been described in e.g. EP-A 209,990, EP-A 209,991, EP-A 216,483, EP-A 218,397, EP-A 227,095, EP-A 227,096, EP-A 229,374, EP-A 235,939, EP-A 247,737, EP-A 257,577, EP-A 257,580, EP-A 258,856, EP-A 279,330, EP-A 279,467, EP-A 285,665, U.S. Pat. No. 4,743,582, U.S. Pat. No. 4,753,922, U.S. Pat. No. 4,753,923, U.S. Pat. No. 4,757,046, U.S. Pat. No. 4,769,360, U.S. Pat. No. 4,771,035, JP 84/78894, JP 84/78895, JP 84/78896, JP 84/227,490, JP 84/227,948, JP 85/27594, JP 85/30391, JP 85/229,787, JP 85/229,789, JP 85/229,790, JP 85/229,791, JP 85/229,792, JP 85/229,793, JP 85/229,795, JP 86/41596, JP 86/268,493, JP 86/268,494, JP 86/268,495, and JP 86/284,489.

The dyes may be used as single components to form a monochrome dye image, e.g. yellow, magenta or cyan dye image, or may be used in admixture, e.g. in a combination forming black as described e.g. in U.S. Pat. No. 4,816,435 and unpublished European patent application (EP-A) 90200991.9.

The dyes are used in the dye/binder layer of a dye-donor element. The dye/binder layer has normally a thickness of about 0.2 to 5.0 μm, preferably 0.4 to 2.0 μm, and the amount ratio of dye to binder is from 9:1 to 1:3 by weight, preferably from 2:1 to 1:2 by weight.

The binder can be chosen from cellulose derivatives like ethyl cellulose, hydroxyethyl cellulose, ethylhydroxy cellulose, ethyl hydroxyethyl cellulose, hydroxypropyl cellulose, methyl cellulose, cellulose acetate, cellulose acetate formate, cellulose acetate propionate, cellulose acetate butyrate, cellulose acetate pentanoate, cellulose acetate hexanoate, cellulose acetate heptanoate, cellulose acetate benzoate, cellulose acetate hydrogen phthalate, cellulose triacetate, and cellulose nitrate; vinyl-type resins like polyvinyl alcohol, polyvinyl acetate, polyvinyl butyral, polyvinyl pyrrolidone, polyvinyl acetoacetal, and polyacrylamide; polymers and copolymers derived from acrylates and acrylate derivatives, such as polyacrylic acid, polymethyl methacrylate, and styrene-acrylate copolymers; polyester resins; polycarbonates; poly(styrene-co-acrylonitrile); polysulfones; polyphenylene oxide; organosilicones such as polysiloxanes; epoxy resins and natural resins, such as gum arabic.

The dye/binder layer can also comprise other components such as e.g. curing agents, preservatives, and other ingredients, which have been described e.g. in EP-A 0,133,011, EP-A 0,133,012, EP-A 0,111,004, and EP-A 0,279,467. The dye can be dispersed or dissolved in a wax type material such as is known from thermal wax transfer printing.

Any material can be used as the support for the dye-donor element provided it is dimensionally stable and capable of withstanding the temperatures involved, i.e. up to 400° C. over a period of up to 20 msec, and is yet thin enough to transmit heat supplied to one side through to the dye on the other side to effect transfer to the receiving sheet within such short periods, typically from 1 to 10 msec. Such materials include polyesters such as polyethylene therephthalate, polyamides, polyacrylates, polycarbonates, cellulose esters, fluorinated polymers, polyethers, polyacetals, polyolefins, polyimides, glassine paper, and condenser paper. Preference is given to a support comprising polyethylene terephthalate. In general, the support has a thickness of 2 to 30 μm. If desired, the support can be coated with an adhesive or subbing layer.

As already mentioned the support of a dye-donor element may be an electrically resistive ribbon consisting of e.g. a multilayered structure of a carbon-loaded polycarbonate coated with a thin aluminium film. Current is injected into the resistive ribbon by electrically addressing a print head electrode, thus resulting in highly localized heating of the ribbon beneath the relevant electrode.

The dye/binder layer of the dye-donor elements can be applied to the support by coating or by printing techniques such as a gravure process.

A dye barrier layer comprising a hydrophilic polymer can be provided between the support and the dye/binder layers of the dye-donor element to improve the dye transfer densities by preventing wrong-way transfer of dye into the support. The dye barrier layers may contain any hydrophilic material that is useful for the intended purpose. In general, good results have been obtained with gelatin, polyacrylamide, polyisopropyl acrylamide, butyl methacrylate-grafted gelatin, ethyl methacrylate-grafted gelatin, ethyl acrylate-grafted gelatin, cellulose monoacetate, methylcellulose, polyvinyl alcohol, polyethylene imine, polyacrylic acid, a mixture of polyvinyl alcohol and polyvinyl acetate, a mixture of polyvinyl alcohol and polyacrylic acid, or a mixture of cellulose monoacetate and polyacrylic acid. Suitable dye barrier layers have been described in e.g. EP-A 0,227,091 and EP-A 0,228,065. Certain hydrophilic polymers e.g. those described in EP-A 0,227,091 also have an adequate adhesion to the support and the dye/binder layer, thus eliminating the need for a separate adhesive or subbing layer. These particular hydrophilic polymers used in one single layer in the dye-donor element thus perform a dual function, hence are referred to as dye barrier/subbing layers.

The colouring matter-containing layer of the donor element as is the case also with the image-receiving layer may contain a releasing agent that aids in separating the donor element from the receptor element after transfer. Suitable releasing agents are already mentioned and are preferably selected from the group consisting of solid waxes, fluorine- or phosphate-containing surfactants and silicone oils and silicone resins as described e.g. in EP 133012, JP 85/19138 and EP 227092.

The transfer of the coloured matter, e.g. meltable or sublimable dye and/or infrared light absorbing compound(s) is accomplished by heating for about several milliseconds at a temperatures in the range of 100° to 400° C.

The thermal transfer of the coloured matter such as an organic dye may be improved by its use in conjunction with a thermal solvent. Thermal solvents are non-hydrolyzable organic compounds that are solid at ambient temperature (20°–25° C.) but liquid at elevated temperature. Preferably they have a melting point between 40° C. and 300° C., more preferably between 40° and 150° C. In fused state they act as a solvent for the dye to be transferred. Examples of thermal solvents have been described in U.S. Pat. Nos. 3,347,675, 3,438,776, 3,667,959 and 4,740,446, published EP-A 0 119 615 and 0122 512 and DE-A 3 339 810. Further such solvents are described in Research Disclosure (December 1976), item 15027 for use in photothermographic methods and materials containing light sensitive silver salts.

In the production of the heat-sensitive donor material the coloured matter, e.g. meltable or sublimable dye, and optional other transferable substances such as thermosolvents for said dyes, are before coating incorporated in a polymeric binder medium dissolved in a suitable solvent or solvent mixture to form a coating composition that is applied to a support, which may have been provided first with an adhesive or subbing layer, and dried. The donor layer containing the heat-transferable matter may be coated on the support by known coating techniques for applying thin liquid coating compositions or may be printed thereon by a printing technique such as a gravure printing process.

The heat-sensitive donor has normally a thickness of about 0.2 to 5.0 μm, preferably in the range of 0.4 to 2.0 μm, and the amount ratio of coloured matter to binder is between 9:1 and 1:3 by weight, preferably between 2:1 and 1:2 by weight.

The dyes may be used as single components to form a monochrome dye image, e.g. yellow, magenta or cyan dye image, or may be used in admixture, e.g. in a combination forming black as described e.g. in U.S. Pat. No. 4,816,435 and published European patent application (EP-A) 90200991.9.

The donor layer may comprise still other substances, such as curing agents, preservatives, etc. These and other ingredients are described e.g. in EP 133011, EP 133012, EP 111004 and EP 279467.

For use in combination with thermal printing heads the reverse side of the donor element is coated preferably with a heat-resistant layer (HR-layer) also called slipping layer to prevent the printing head from sticking to the dye-donor element. Such slipping layer also called HR-layer comprises a lubricating material. Examples of suitable lubricating materials are a surface active agent, a liquid lubricant, a solid lubricant or mixtures thereof, with or without a polymeric binder. The surface active agents may be any agents known in the art such as carboxylates, sulfonates, phosphates, aliphatic amine salts, aliphatic quaternary ammonium salts, polyoxyethylene alkyl ethers, polyethylene glycol fatty acid esters, fluoroalkyl $C_2$–$C_{20}$ aliphatic acids. Examples of liquid lubricants include silicone oils, synthetic oils, saturated hydrocarbons and glycols. Examples of solid lubricants include various higher alcohols such as stearyl alcohol, fatty acids and fatty acid esters. Suitable HR-layers are described in e.g. EP 138483, EP 227090, U.S. Pat. Nos. 4,567,113, 4,572,860, 4,717,711 and in published European patent application 311841. A possible HR-layer is an outermost layer obtained by coating a solution of at least one silicon compound and a substance capable of forming during the coating procedure a polymer having an inorganic backbone which is an oxide of a group IVa or IVb element as described in published European patent application 92203496.

Another suitable HR-layer comprises as binder a copolystyrene-acrylonitrile copolymer or a styrene-acrylonitrile-butadiene copolymer or a mixture hereof and as lubricant in an amount of 0.1 to 10% by weight of the binder (mixture) a polysiloxane-polyether copolymer or polytetrafluoroethylene or a mixture hereof.

Lubricants can be incorporated into the heat-resistant layer or are applied in a separate topcoat thereto.

The following examples illustrate the present invention without however limiting it thereto.

All ratios and percentages are by weight unless otherwise indicated.

EXAMPLE 1 (Comparative Example)

Preparation of a receptor material $R_1$ according to the present invention

Onto a polyester sheet having a thickness of 63 μm were coated in the order given:

- a first coating from a solution in methyl ethyl ketone of leucobase 1 and a poly(vinyl chloride-co-vinyl acetate) marketed under the tradename SOLVIC 560 RA by Solvic N. V. Belgium. The dried coated layer contained 2 g/m² of binder and 2.5 g/m² of leucobase 1 as described hereinafter.
- a second coating from an aqueous dispersion (latex) of a vinylidene chloride copolymer sold under the tradename IXAN WA36 by Solvay S. A. Belgium was applied to form on drying a barrier layer allowing the acid-reacting chemical of the third layer to penetrate when heated by printhead resistors. The coverage of the dried layer was 0.5 g/m².
- a third layer from a mixture of methanol-isopropanol (4:1) containing as acid precursor p-hydroxybenzoic acid benzyl ester applied at a coverage of 2.25 g/m² and as binding agent cellulose nitrate applied at a coverage of 1.25 g/m².
- a fourth layer being a dye receiving layer suited for use in a thermal dye diffusion transfer process. Said layer was applied from an aqueous medium containing in a 1/100 ratio a polysiloxane-polyether copolymer (TEGOGLIDE 100, tradename of T. H. Goldschmidt) and a polyester being resin no. 1 of Example 1 of published European patent application 0 481 130. The solids coverage of the dried layer was 5 g/m².

leucobase 1

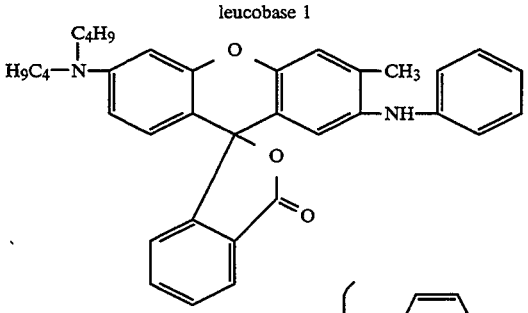

Preparation of comparison test receptor material RC1 (non-invention material)

Receptor material RC1 was prepared as described for receptor material R1 with the difference however that first, second and third layer were omitted and the fourth layer being the dye receiving layer was coated directly onto the polyester support.

Preparation of a dye-donor element D1 for use according to the present invention in conjunction with receptor material R1.

The dye-donor element D1 suited for use in thermal dye sublimation transfer imaging was prepared as follows.

A methyl ethyl ketone solution was made containing 8% of dye A, 2.4% of dye B, 6.4% of dye C, 8% of copoly(styrene-acrylonitrile) sold under the tradename LURAN 388 S by BASF, Germany as binder and 1% amide wax. By said mixture of dyes a black coating is obtained.

dye A

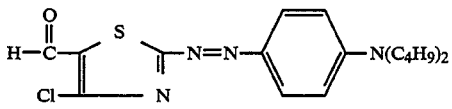

dye B

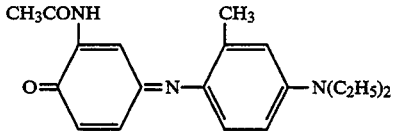

dye C

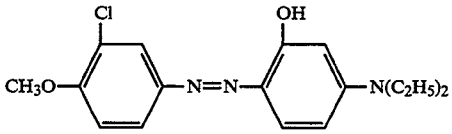

The coating composition was applied at a wet thickness of 10 μm was coated onto a 5 μm thick polyethylene terephthalate film support provided with a conventional subbing layer. The resulting layer was dried by evaporation of the solvent.

The opposite side of the film support was coated with a subbing layer of a copolyester being a polycondensation product of ethylene glycol, adipic acid, neopentyl glycol, terephthalic acid, isophthalic acid and glycerol. On top of this subbing layer, a heat-resistant layer was coated from methyl ethyl ketone containing a polycarbonate of the following structure coated at a coverage of 0.5 g/m²:

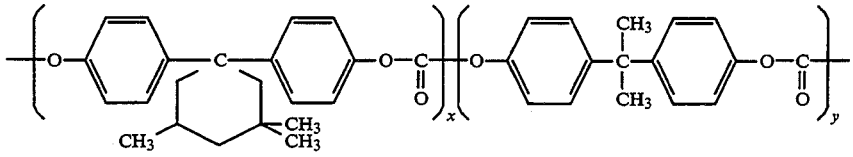

wherein x=55 mol % and y=45 mol %.

On top of said polycarbonate layer, a topcoat layer of polyether modified polydimethylsiloxane (TEGOGLIDE 410, tradename of T. H. Goldschmidt) was applied from isopropanol.

Comparison test donor material DC1

For comparative test purposes in the above dye donor material the dye layer was omitted and said donor material DC1 called "blanco-donor element"

Preparation of receptor bi-pack material R2 for use according to the present invention Said material was built as a bi-pack, so made up on two separate supports that can be held in contact with each other during the thermographic printing.

PART 1

Analogously to Example 1 onto a polyester sheet having a thickness of 63 μm the first and second coating as described above were applied in the indicated order.

PART 2

A 5 μm polyester sheet was coated on one side with said third layer as described above and at the other side with a subbing layer from methyl ethyl ketone containing an aromatic copolyester whereon from the same solvent a dye-receiving layer was coated. The dried dye-receiving layer contained 3.6 g/m$^2$ poly(vinylchloride-co-vinylacetate-co-vinylalcohol marketed under the tradename VINYLITE VAGD by Union Carbide, 0.336 g/m$^2$ the diisocyanate DESMODUR VL supplied by Bayer AG and 0.2 g/m$^2$ hydroxy modified polydimethylsiloxane marketed under the tradename TEGOMER H SI 2111 by T. H. Goldschmidt.

During the thermographic printing stage with a thermographic resistor array printing head part 1 is kept into contact with part 2 through said second and third layer.

Preparation of comparison test receptor bi-pack material RC2 (non-invention material)

The composition of said comparison test material is the same as for bi-pack material C with the proviso that in part 1 said first and second layer were omitted and in part 2 said third layer is absent.

Thermographic printing

Thermographic printing was carried out by means of a MITSUBISHI CP100 (tradename) printer operating with a thermal head on the basis of an array of tiny electrically heated resistor elements receiving digitized image signals.

In the thermographic printing stage the above defined donor and dye-receiving materials were combined with each other as mentioned in the following Table 1 wherein the dye donor layer, when present, is facing the described dye receiving layer.

In said Table 1 the maximum density ($D_{max}$) and minimum density ($D_{min}$) obtained by means of the described comparative test combinations are given.

TABLE 1

| Test | Receptor material | Donor material | $D_{max}$ | $D_{min}$ |
|---|---|---|---|---|
| 1 | R1 | D1 | 2.80 | 0.16 |
| 2 | RC1 | D1 | 1.67 | 0.20 |
| 3 | R1 | DC1 | 1.09 | 0.13 |
| 4 | R2 | D1 | 2.08 | 0.09 |
| 5 | RC2 | DC1 | 1.34 | 0.07 |

From the density results of the test 1 and 4 "invention" receptor-donor combinations in comparison with the results of the comparison "non-invention" tests 2, 3 and 5 can be learned that a substantial increase in optical density is obtained by forming a thermal dye transfer printing image in superposition to a direct thermographic printing image.

EXAMPLE 2 (Comparative Example)

Preparation of a receptor material R20 according to the present invention

Onto a polyester sheet having a thickness of 100 μm were coated in the order given:

a first coating from a dispersion in methyl ethyl ketone containing the following ingredients:

1) as binder copoly(vinyl chloride/vinylidene chloride) marketed under the tradename RHENOFLEX 63 by Dynamit Nobel AG Germany
2) silver behenate
3) behenic acid
4) reductor R1 (structural formula defined hereinafter)
5) image toning agent T (structural formula defined hereinafter)
6) silicone BAYSILONE Öl (tradename of BAYER AG Germany)

The dried coated layer contained 6.31 g/m$^2$ of binder, 2.1 g/m$^2$ of silver behenate, 0.21 g/m$^2$ of behenic acid, 0.32 g/m$^2$ of reductor R, 0.16 g/m$^2$ of image toning agent T and 0.025 g/m$^2$ of silicone.

a second coating D 520 coated from the following ingredients at 22 m$^2$/l:

1) ethanol 960 ml
2) glacial acetic acid 40 ml
3) ethylcellulose N7 marketed by Hercules U.S.A. 20 g The coverage of the dried layer was 0.5 g/m$^2$.

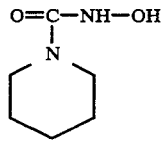

reductor R1

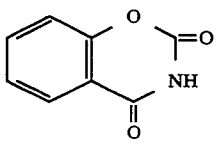

image toning agent T

Preparation of comparison test receptor material RC20 (non-invention material)

Receptor material RC20 was prepared as described for receptor material R20 with the difference however that the first layer was omitted and the second layer being the dye receiving layer was coated directly onto the polyester support.

Preparation of the dye-donor element D1 for use according to the present invention in conjunction with receptor material R20.

The dye-donor element D1 for producing a black transfer image was prepared as described in Example 1.

Comparison test donor material DC1

For comparative test purposes in the above dye donor material the dye layer was omitted and said material called "blanco-donor element"

Thermographic printing

Thermographic printing was carried out by means of a MITSUBISHI CP100 (tradename) printer operating with a thermal head on the basis of an array of tiny electrically heated resistor elements receiving digitized image signals.

In the thermographic printing stage the above defined donor and dye-receiving materials were combined with each other as mentioned in the following Table 2 wherein the dye donor layer, when present, is facing the described dye receiving layer.

In said Table 2 the maximum density ($D_{max}$) and minimum density ($D_{min}$) obtained by means of the described comparative test combinations are given.

TABLE 2

| Test | Receptor material | Donor material | $D_{max}$ | $D_{min}$ |
|---|---|---|---|---|
| 1 | R20 | D1 | 1.64 | 0.07 |
| 2 | RC20 | D1 | 1.44 | 0.06 |
| 3 | R20 | DC1 | 0.80 | 0.06 |

From the density results of the test 1 relating to an "invention" receptor-donor combination in comparison with the results of the comparison "non-invention" tests 2 and 3 can be learned that a substantial increase in optical density is obtained by forming a thermal dye transfer printing image in superposition to a silver image obtained direct thermographic printing.

EXAMPLE 3 (Comparative Example)

Preparation of a receptor material R30 according to the present invention

Onto a polyester sheet having a thickness of 100 μm were coated in the order given:

a first coating was applied under ultraviolet radiation containing white light conditions from a dispersion in methyl ethyl ketone containing following ingredients, their coverage in g/m$^2$ being given between brackets 1) as binder copoly(vinylbutyral/vinyl alcohol/vinyl acetate) marketed under the tradename BUTVAR B79 by Monsanto, U.S.A. (6.45).
2) silver bromide-iodide (av.grain size: 0.05 μm)(15 mol % $I^-$) (1.0)
3) silver behenate (4.76)
4) palmitic acid (0.29)
5) sodium palmitate (0.088)
6) succinimide (0.38)
7) reductor R2 with structural formula as defined hereinafter (2.81)
8) wetting agent TEGOGLIDE 410 [tradename of T. D Goldschmidt] ($85\times10^3$)

a second coating being a gelatin layer at a coverage of 1 g/m$^2$.

a third layer was coated from a solution in methyl ethyl ketone of the following ingredients:

1) as binder copoly(vinyl chloride/vinyl alcohol/vinyl acetate) sold under the tradename VINYLITE VAGH of Union Carbide U.S.A. (3.6)
2) diisocyanate sold under the tradename DESMODUR VL of Bayer AG (0.36)
3) a hydroxy modified polydimethylsiloxane sold under the tradename TEGOMER HSI by T. H. Goldschmidt (0.15)
4) a metal soap SICCATOL Zn-12 (tradename of AKZO, The Netherlands) as cross-linking accelerator (0.014)

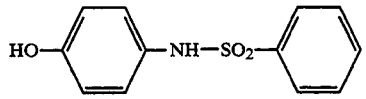

reductor R2

Preparation of the dye-donor element D1 for use according to the present invention in conjunction with receptor material R30.

The dye-donor element D1 for producing a black transfer image was prepared as described in Example 1.

The "blanco-donor element" DC1 was prepared as described in Example 1.

Thermographic printing

Thermographic printing was carried out by means of a MITSUBISHI CP100 (tradename) printer operating with thermal head comprising an array of tiny electrically heated resistor elements receiving digitized image signals.

In the thermographic printing stage the above defined donor and dye-receiving material were combined with each other, the donor layer facing the described dye receiving layer.

In Table 3 the maximum density ($D_{max}$) and minimum density ($D_{min}$) obtained by means of the described comparative test combinations are given.

TABLE 3

| Test | Receptor material | Donor material | $D_{max}$ | $D_{min}$ |
|---|---|---|---|---|
| 1 | R30 | D1 | 3.20 | 0.25 |
| 2 | R30 | DC1 | 1.45 | 0.20 |

We claim:

1. A thermal imaging process comprising the step of imagewise heating a donor element so as to transfer therefrom coloured matter onto a contacting receptor element, characterized in that said receptor element has a binder layer which contains a chemical composition of substances for producing a change in colour due to a chemical reaction activated by heat and wherein before said imagewise heating said receptor element contains in a layer at least one substance that by heat applied in the transfer of said coloured matter undergoes a change giving rise to an increase in optical density.

2. Thermal imaging process according to claim 1, wherein imagewise transfer of coloured matter onto the receptor element proceeds by Joule effect heating in that selectively energized electrical resistors of a thermal head array are used in contact with a thin thermally stable resin base of said donor element.

3. Thermal imaging process according to claim 1, wherein imagewise transfer of coloured matter onto the receptor element proceeds by imagewise Joule effect heating of the support of the donor element being an electrically resistive ribbon.

4. Thermal imaging process according to claim 1, wherein the imagewise heating of the donor element proceeds by means of laser light.

5. Thermal imaging process according to claim 1, wherein the imagewise heating of the donor element proceeds by means of pixelwise modulated ultra-sound.

6. Thermal imaging process according to claim 1, wherein said colouring matter is a meltable or sublimable dye or mixture of dyes present in the donor element in a wax or polymeric binder layer.

7. Thermal imaging process according to claim 1, wherein said donor element contains said heat-transferable coloured substance in conjunction with at least one infrared light absorbing substance which is transferable by heat and forms an infrared light absorbing pattern on said receptor element and following the transfer of said infrared light absorbing substance the receptor element is exposed uniformly to infrared radiation absorbed by said pattern thereby generating additional heat in said receptor element for enhancing imagewise therein the optical density.

8. Thermal imaging process according to claim 1, wherein the receptor element contains a diazo system wherein the coupler and/or base needed to form a dye by reaction with a diazonium salt are available in chemically blocked state wherefrom they can be set free by heat and allowed to react with the diazonium salt in the receptor element.

9. Thermal imaging process according to claim 1, wherein the receptor element contains a leuco dye/acid system of which the leucodye and acid or a thermosensitive acid precursor are kept separate prior to said imagewise heating.

10. Thermal imaging process according to claim 1, wherein the receptor element contains an organic reducible silver salt and a reducing agent optionally in the presence of small amounts of silver halide that in a redox reaction will produce silver metal.

* * * * *